US007350577B2

(12) United States Patent
Howard et al.

(10) Patent No.: US 7,350,577 B2
(45) Date of Patent: Apr. 1, 2008

(54) METHOD AND APPARATUS FOR INJECTING STEAM INTO A GEOLOGICAL FORMATION

(75) Inventors: William F. Howard, West Columbia, TX (US); Jackie C. Sims, Houston, TX (US); Dudley L. Robinson, Houston, TX (US); Ronald W. Schmidt, Richmond, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 409 days.

(21) Appl. No.: 10/506,695

(22) PCT Filed: Mar. 13, 2003

(86) PCT No.: PCT/US03/07771

§ 371 (c)(1),
(2), (4) Date: Sep. 3, 2004

(87) PCT Pub. No.: WO03/078791

PCT Pub. Date: Sep. 25, 2003

(65) Prior Publication Data

US 2005/0150657 A1 Jul. 14, 2005

Related U.S. Application Data

(63) Continuation-in-part of application No. 10/097,448, filed on Mar. 13, 2002, now Pat. No. 6,708,763.

(51) Int. Cl.
*E21B 43/24* (2006.01)

(52) U.S. Cl. ..... 166/303; 166/222; 166/242.5

(58) Field of Classification Search ..... 166/303, 166/222, 169, 242.5
See application file for complete search history.

(56) References Cited

U.S. PATENT DOCUMENTS

| | | | | |
|---|---|---|---|---|
| 1,612,611 | A * | 12/1926 | Claytor | 299/5 |
| 2,227,539 | A | 1/1941 | Dorton | |
| 4,050,515 | A | 9/1977 | Hamrick | |
| 4,336,839 | A * | 6/1982 | Wagner et al. | 166/59 |
| 4,557,329 | A | 12/1985 | Savard | |
| 4,640,355 | A | 2/1987 | Hong et al. | |

(Continued)

OTHER PUBLICATIONS

PCT International Search Report dated Jul. 29, 2003 based on PCT/US03/07771.

(Continued)

*Primary Examiner*—David Bagnell
*Assistant Examiner*—Shane Bomar
(74) *Attorney, Agent, or Firm*—Patterson & Sheridan, LLP

(57) ABSTRACT

The present invention generally provides a method and apparatus for injecting a compressible fluid at a controlled flow rate into a geological formation at multiple zones of interest. In one aspect, the invention provides a tubing string with a pocket and a nozzle at each isolated zone. The nozzle permits a predetermined, controlled flow rate to be maintained at higher annulus to tubing pressure ratios. In another aspect, the present invention assures that the fluid is supplied uniformly to a long horizontal wellbore by providing controlled injection at multiple locations that are distributed throughout the length of the wellbore. In another aspect, the invention ensures that saturated steam is injected into a formation in a predetermined proportion of water and vapor by providing a plurality of apertures between a tubing wall and a pocket.

23 Claims, 11 Drawing Sheets

U.S. PATENT DOCUMENTS

| | | | |
|---|---|---|---|
| 4,646,828 | A | 3/1987 | Schwab, Jr. et al. |
| 4,648,455 | A | 3/1987 | Luke |
| 4,770,244 | A | 9/1988 | Webb |
| 4,921,044 | A | 5/1990 | Cooksey |
| 5,018,576 | A | 5/1991 | Udell |
| RE33,614 | E | 6/1991 | Schwab, Jr. et al. |
| 5,024,274 | A | 6/1991 | Schwab, Jr. |
| 5,141,054 | A | 8/1992 | Alameddine et al. |
| 5,141,055 | A | 8/1992 | Chien et al. |
| 5,365,795 | A | 11/1994 | Brower |
| 5,464,059 | A | 11/1995 | Kristiansen |
| 5,707,214 | A | 1/1998 | Schmidt |
| 5,743,717 | A | 4/1998 | Schmidt |
| 5,990,370 | A | 11/1999 | Sims |
| 6,318,464 | B1 | 11/2001 | Mokrys |

OTHER PUBLICATIONS

Suzanne Griston, et al., "Field Test Of Tapered-Bore Chokes For Steam Flow Control", Abstract, SPE #35677, May 22, 1996, pp. 269-283, XP002248011, Introduction, p. 269, col. 2, Figures 1, 2.

* cited by examiner

METHOD AND APPARATUS FOR INJECTING STEAM INTO A GEOLOGICAL FORMATION

CROSS-REFERENCE TO RELATED APPLICATIONS

This application is a continuation-in-part of U.S. patent application Ser. No. 10/097,448, filed Mar. 13, 2002, now U.S. Pat. No. 6,708,763, which is herein incorporated by reference.

BACKGROUND OF THE INVENTION

1. Field of the Invention

The present invention relates to the production of hydrocarbon wells. More particularly the invention relates to the use of pressurized steam to encourage production of hydrocarbons from a wellbore. More particularly still, the invention relates to methods and apparatus to inject steam into a wellbore at a controlled flow rate in order to urge hydrocarbons to another wellbore.

2. Description of the Related Art

To complete a well for hydrocarbon production, a wellbore drilled in the earth is typically lined with casing which is inserted into the well and then cemented in place. As the well is drilled to a greater depth, smaller diameter strings of casing are lowered into the wellbore and attached to the bottom of the previous casing string. Casing strings of an ever-decreasing diameter are placed into a wellbore in a sequential order, with each subsequent string necessarily being smaller than the one before it.

Increasingly, lateral wellbores are created in wells to more completely or effectively access hydrocarbon-bearing formations. Lateral wellbores may be formed off of a vertical wellbore, typically from the lower end of the vertical wellbore, and may be directed outwards through the use of some means of directional drilling, such as a diverter. The end of the lateral wellbore which is closest to the vertical wellbore is the heel, while the opposite end of the lateral wellbore is the toe. Alternatively, lateral wellbores may be formed in a formation merely by directional drilling rather than formed off of a vertical wellbore. After a lateral wellbore is formed, it may be lined with casing or may remain unlined.

Artificial lifting techniques are well known in the production of oil and gas. The hydrocarbon formations accessed by most wellbores do not have adequate natural pressure to cause the hydrocarbons to rise to the surface on their own. Rather, some type of intervention is used to encourage production. In some instances, pumps are used either in the wellbore or at the surface of the well to bring fluids to the surface. In other instances, gas is injected into the wellbore to lighten the weight of fluids and facilitate their movement towards the surface.

In still other instances, a compressible fluid like pressurized steam is injected into an adjacent wellbore to urge the hydrocarbons towards a producing wellbore. This is especially prevalent in a producing field with formations having heavy oil. The steam, through heat and pressure, reduces the viscosity of the oil and urges or "sweeps" it towards another wellbore. In a simple arrangement, an injection well includes a cased wellbore with perforations at an area of the wellbore adjacent a formation or production zone of interest. The production zones are typically separated and isolated from one another by layers of impermeable material. The area of the wellbore above and below the perforations is isolated with packers and steam is injected into the wellbore either by using the casing itself as a conduit or through the use of a separate string of tubulars coaxially disposed in the casing. The steam is generated at the surface of the well and may be used to provide steam to several injection wells at once. If needed, a simple valve monitors the flow of steam into the wellbore. While the forgoing example is adequate for injecting steam into a single zone, in vertical wellbores, there are more typically multiple zones of interest adjacent a wellbore and sometimes it is desirable to inject steam into multiple zones at different depths of the same wellbore. Because each wellbore includes production zones with varying natural pressures and permeabilities, the requirement for the injected steam can vary between zones, creating a problem when the steam is provided from a single source.

One approach to injecting steam into multiple zones is simply to provide perforations at each zone and then inject the steam into the casing. While this technique theoretically exposes each zone to steam, it has practical limitations since most of the steam enters the highest zone in the wellbore (the zone having the least natural pressure or the highest permeability). In another approach, separate conduits are used between the injection source and each zone. This type of arrangement is shown in FIG. 1. FIG. 1 illustrates a vertical wellbore 100 having casing 105 located therein with perforations 110 in the casing adjacent each of three separate zones of interest 115, 120, 125. As is typical with a wellbore, a borehole is first formed in the earth and subsequently lined with casing. An annular area formed between the casing and the borehole is filled with cement (not shown) which is injected at a lower end of the wellbore. Some amount of cement typically remains at the bottom of the wellbore. The upper and intermediate zones are isolated with packers 130 and a lower end of one tubular string 135, 140, 145 terminates within each isolated zone. A steam generator 150 is located at the surface of the well and a simple choke 155 regulates the flow of the steam into each tubular. This method of individual tubulars successfully delivers a quantity of steam to each zone but regulation of the steam to each zone requires a separate choke. Additionally, the apparatus is costly and time consuming to install due to the multiple, separate tubular strings 135, 140, 145.

More recently, a single tubular string has been utilized to carry steam in a single wellbore to multiple zones of interest. In this approach, an annular area between the tubular and the zone is isolated with packers and a nozzle located in the tubing string at each zone delivers steam to that zone. The approach suffers the same problems as other prior art solutions in that the amount of steam entering each zone is difficult to control and some zones, because of their higher natural pressure or lower permeability, may not receive any steam at all. While the regulation of steam is possible when a critical flow of steam is passed through a single nozzle or restriction, these devices are inefficient and a critical flow is not possible if a ratio of pressure in the annulus to pressure in the tubular becomes greater than 0.56. In order to ensure a critical flow of steam through these prior art devices, a source of steam at the surface of the well must be adequate to ensure an annulus/tubing pressure ratio of under 0.56.

Critical flow is defined as flow of a compressible fluid, such as steam, through a nozzle or other restriction such that the velocity at least one location is equal to the sound speed of the fluid at local fluid conditions. Another way to say this is that the Mach number of the fluid is 1.0 at some location. When the condition occurs, the physics of compressible fluids requires that the condition will occur at the throat (smallest restriction) of the nozzle. Once sonic velocity is reached at the throat of the nozzle, the velocity, and therefore the flow rate, of the gas through the nozzle cannot increase regardless of changes in downstream conditions. This yields a perfectly flat flow curve so long as critical flow is maintained.

Another disadvantage of the forgoing arrangements relates to ease of changing components and operating characteristics of the apparatus. Over time, formation pressures and permeability associated with different zones of a well change and the optimal amount (flow rate) and pressure of steam injected into these zones changes as well. Typically, a different choke or nozzle is required to change the characteristics (flow rate and steam quality) of the injected steam. Because the nozzles are an integral part of a tubing string in the conventional arrangements, changing them requires removal of the string, an expensive and time-consuming operation.

Another problem with prior art injection methods involves the distribution of steam components. Typically, steam generated at a well site for injection into hydrocarbon bearing formations is made up of a component of water and a component of vapor. In one example, saturated steam that is composed of 70 percent vapor and 30 percent water by mass is distributed to several steam injection wells. Because the vapor and water have different flow characteristics, it is common for the relative proportions of water and vapor to change as the steam travels down a tubular and through some type of nozzle. For example, it is possible to inadvertently inject mostly vapor into a higher formation while injecting mostly water into lower formations. Because the injection process relies upon an optimum mixture of steam components, changes in the relative proportions of water and vapor prior to entering the formations is a problem that affects the success of the injection job.

Additional problems are also encountered with injection methods involving lateral wellbores. Although vertical wellbores typically have multiple zones of interest which must be treated, lateral wellbores ordinarily have only one zone of interest along the length of the lateral wellbore. Therefore, different pressures for different zones of interest, which are often desired for treating vertical wellbores, are not necessary in treating the zone of interest in the lateral wellbore. For lateral wellbores, it is desirable for the entire zone of interest to be treated equally with compressible fluid at the same pressure along the length of the lateral wellbore.

Ordinarily, steam is injected from the heel of the lateral wellbore. Because the injection is from the heel of the wellbore, the steam often has a higher pressure at the heel of the wellbore than at the toe due to pressure loss in the steam resulting from frictional resistance along the length of the wellbore as the steam travels downstream. As a result, as steam travels along the horizontal wellbore, its pressure typically undesirably varies along the length of the wellbore.

Along the length of the lateral wellbore, the steam also tends to separate, with the liquid phase flowing along the bottom of the wellbore and the vapor phase flowing into the upper portion of the wellbore. Because the phases tend to separate, the steam injected into the zone of interest along the wellbore may not be uniform in phase components. It is desirable for the steam to have a uniform phase distribution (liquid to vapor ratio) along the length of the lateral wellbore so that the zone of interest is treated equally along its length.

There is a need therefore, for an apparatus and method of injecting steam into multiple zones at a controlled flow rate and pressure in a single wellbore that is more efficient and effective than prior art arrangements. There is a further need for an injection apparatus with components that can be easily changed. There is a further need for an injection system that is simpler to install and remove. There is yet a further need to provide steam to multiple zones in a wellbore in predetermined proportions of water and vapor. There is yet a further need for a single source of steam provided to multiple, separate wellbores using a controlled flow rate. There is yet a further need for an apparatus and method for injecting steam into a zone of interest along the length of a lateral wellbore at a controlled flow rate and pressure. There is yet a further need for an apparatus and method for injecting steam into a zone of interest along the length of a lateral wellbore in predetermined proportions of water and vapor.

SUMMARY OF THE INVENTION

The present invention generally provides a method and apparatus for injecting a compressible fluid at a controlled flow rate into a geological formation at multiple zones of interest. In one aspect, the invention provides a tubing string with a pocket and a nozzle at each isolated zone. The nozzle permits a predetermined, controlled flow rate to be maintained at higher annulus to tubing pressure ratios. The nozzle includes a diffuser portion to recover lost steam pressure associated with critical flow as the steam exits the nozzle and enters a formation via perforations in wellbore casing. In another aspect, the invention ensures steam is injected into a formation in a predetermined proportion of water and vapor by providing a plurality of apertures between a tubing wall and a pocket. The apertures provide distribution of steam that maintains a relative mixture of water and vapor. In another aspect of the invention, a single source of steam is provided to multiple, separate wellbores using the nozzle of the invention to provide a controlled flow of steam to each wellbore.

The present invention further generally provides a method and apparatus for injecting a compressible fluid at a controlled flow rate into a geological formation into a zone of interest along the length of a lateral wellbore. In one aspect, the present invention provides a tubing string with a pocket and nozzle within the lateral wellbore. The pocket is disposed concentrically around the tubing string. The nozzle permits a predetermined, controlled flow rate to be maintained. An obstructing member is placed opposite the nozzle to prevent the steam from flowing in the preferential direction of the nozzle to produce a substantially uniform distribution of steam pressure along the length of the wellbore. In another aspect, the invention provides a plurality of apertures circumferentially distributed around the tubing string adjacent to the pocket to provide a distribution of steam that maintains a relative mixture of water and vapor along the length of the lateral wellbore. In yet another aspect, multiple pockets with corresponding nozzles may be spaced along the length of the tubing string.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention provides an apparatus and methods to inject steam into a geological formation from a wellbore.

Figure 1:
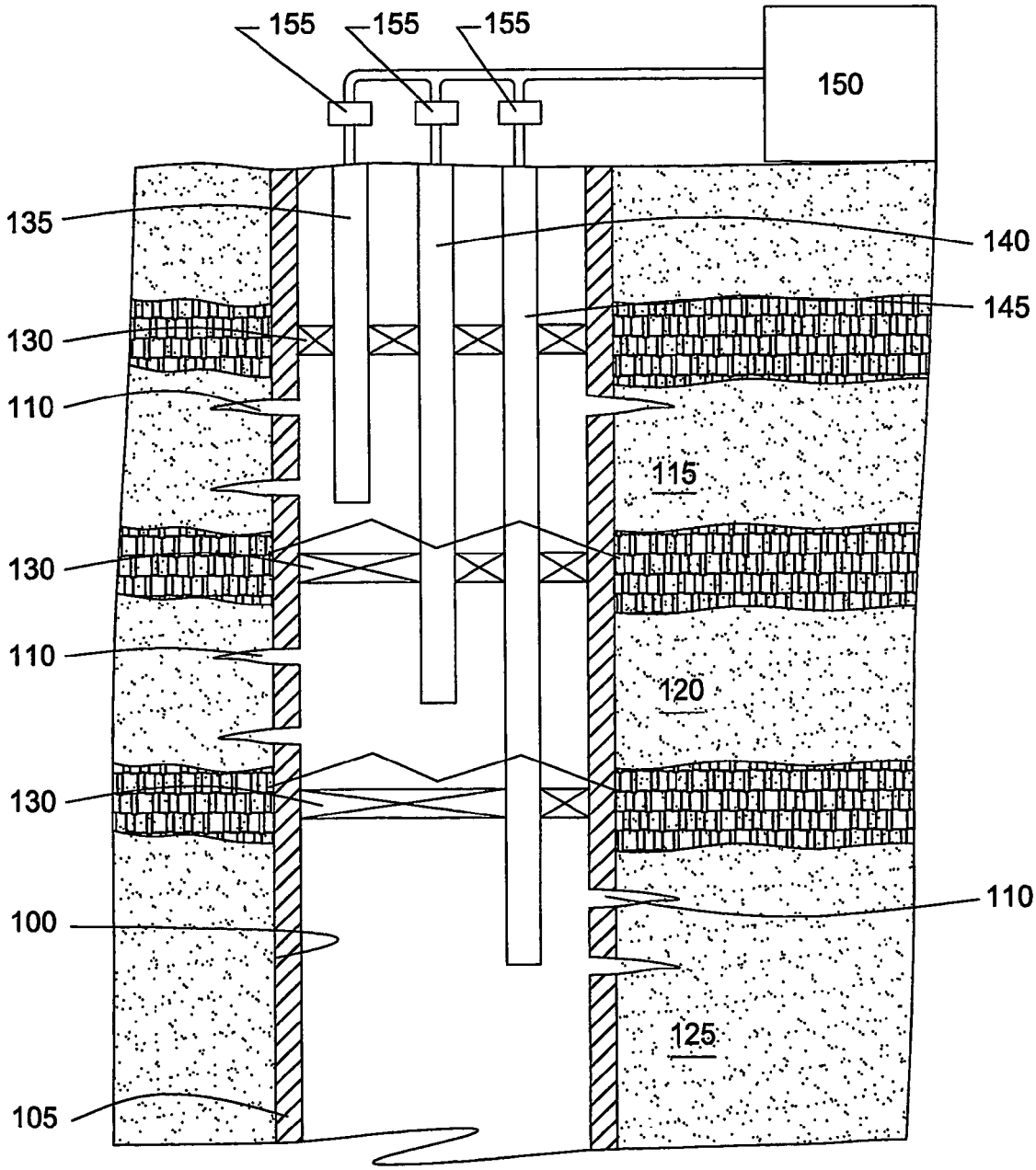
FIG. 1 (PRIOR ART)
FIG. 1 is a section view of a wellbore having three separate tubular strings disposed therein, each string accessing a separate zone of the wellbore.
Figure 2:
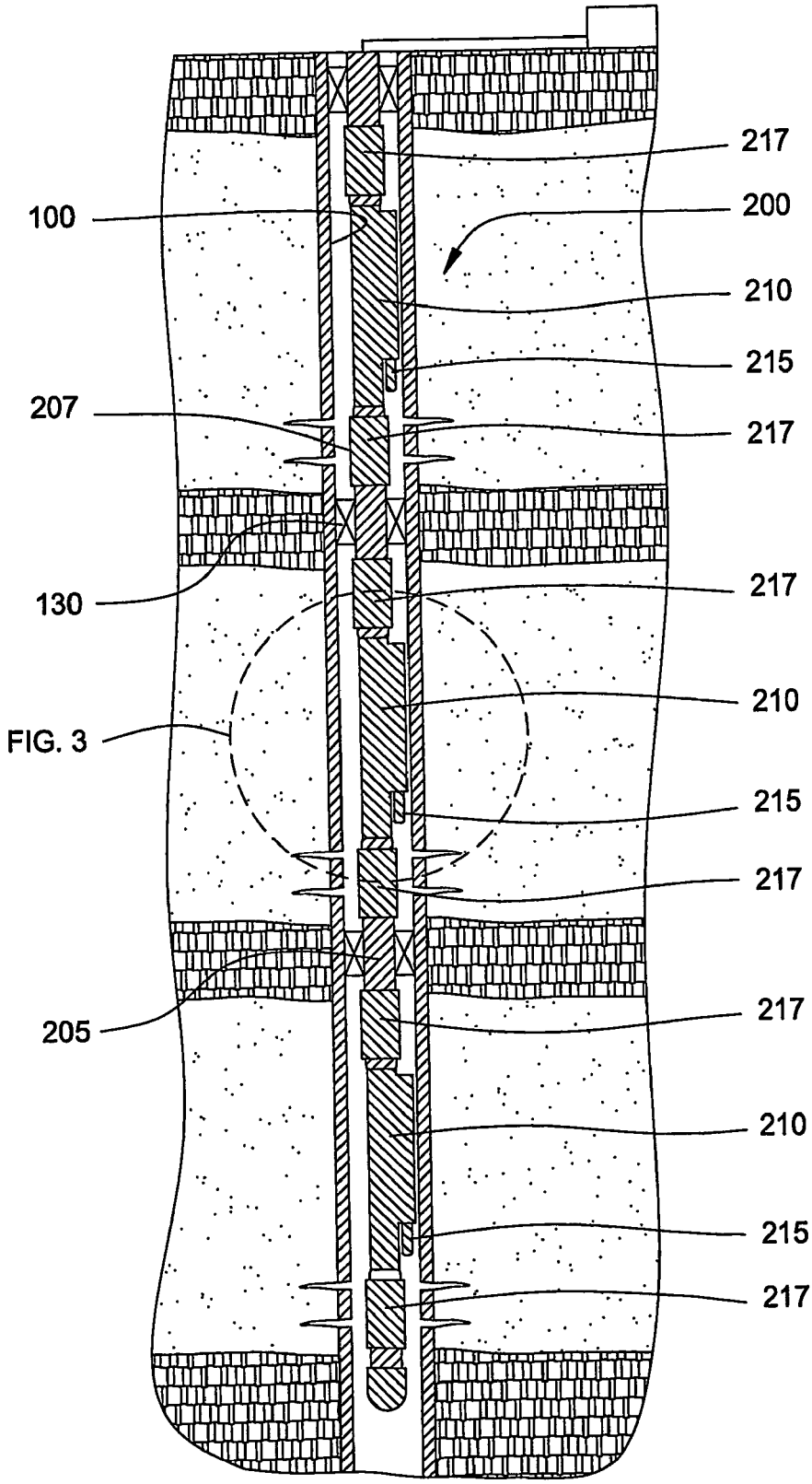
FIG. 2 is a section view of a vertical wellbore illustrating an apparatus of the present invention accessing three separate zones in the wellbore.

FIG. 2 is a section view of a vertical wellbore 100 illustrating an apparatus 200 of the present invention disposed in a wellbore. A string of tubulars 205 is coaxially disposed in the wellbore 100. In the embodiment of FIG. 2, the tubing string includes three enlarged area or pockets 210 formed therein, each of which define an annular area with the casing and include a nozzle 215 at one end. The apparatus is located in a manner whereby the pockets formed in the tubular are adjacent perforated sections of the casing. Each perforated area corresponds to a zone of the well to be injected with steam. Each pocket is preferably formed in a sub that can be located in the tubular string and then positioned adjacent a zone. Each nozzle provides fluid communication between the apparatus and a zone of interest. Each zone is isolated with packers 130 to ensure that steam leaving the pocket via the nozzle travels through the adjacent perforations in the casing. Each nozzle is formed with a throat 250 and diffuser portion 245 (FIG. 4) to efficiently utilize the steam as will be described. In use, the apparatus 200 is intended to deliver a source of steam from the surface of the well to each zone and to ensure that each zone receives a predetermined amount of steam, and that amount of steam is determined by the supply pressure at the surface and the characteristics of the nozzle. As shown in FIG. 2, the number of subs depends upon the number of zones to be serviced. The subs are disposed in the tubing string with threaded connectors 217 at each end. The packers 130 are typically cup packers and each may include a pair of cup packers to prevent flow across the packers in either direction.

Figure 3:
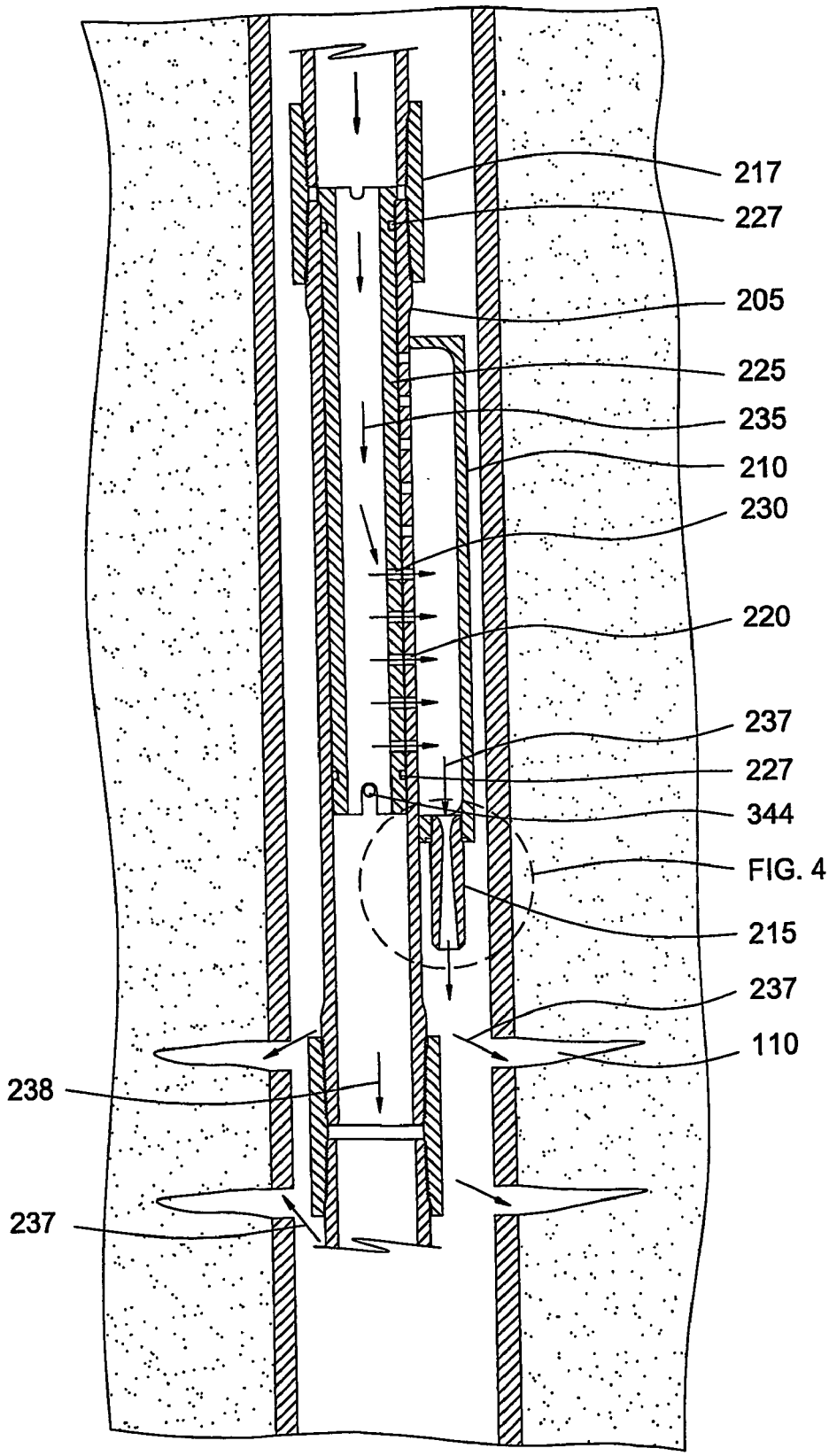
FIG. 3 is an enlarged view of the apparatus of FIG. 2 including a tubular body with apertures in a wall thereof, a pocket formed adjacent the body, and a nozzle having a diffuser portion.

FIG. 3 is an enlarged view of a portion of the tubing 205 and the adjacent pocket 210. Fluid communication between the tubular and the pocket is provided with a plurality of apertures 220 formed in a wall of the tubular adjacent the pocket. Additionally, a sleeve 225 is located in the interior of the tubular to permit selective use of the apertures 220 depending upon the amount of steam needed at the zone. The sleeve 225 is preferably fitted into the tubing at the surface of the well prior to run in. The apertures 230 of the sleeve are constructed and arranged to align with the apertures 220 of the tubing 205. The use of a sleeve having a predetermined number of apertures permits fewer than all of the apertures in the tubing to be utilized as a fluid path between the tubing and the pocket. In this manner, the characteristics of the steam at a particular pocket 210 can be determined by utilizing a sleeve with more or fewer apertures rather than fabricating a tubing for each application. The sleeve 225 is sealed within the tubing with seal rings 227 at each end of the sleeve 225. A slot and pin arrangement 344 between the sleeve 225 and the tubing 205 rotationally aligns the aperture of the sleeve with those of the tubing. The flow of steam from the tubing through the apertures 230 of the sleeve is shown with arrows 235. Steam in the pocket 210 thereafter travels from the nozzle through the perforations as shown by arrows 237. A portion of the steam continues downward as shown by arrow 238 to service another pocket located on the tubular string below.

Figure 4:
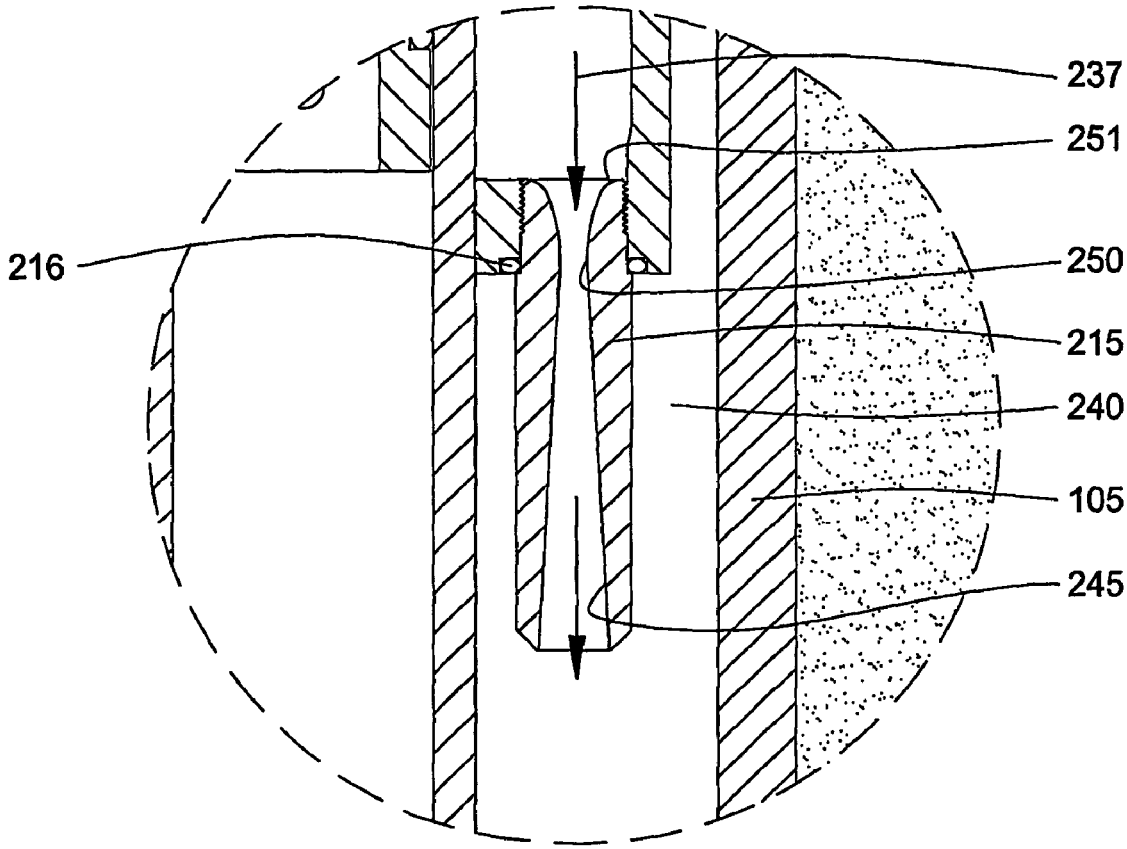
FIG. 4 is an enlarged view of the nozzle of the apparatus showing a throat and the diffuser portion of the nozzle.

FIG. 4 is an enlarged view of the nozzle 215 providing fluid communication between pocket 210 and an annular area 240 defined between the tubing and the wellbore casing and sealed at either end with a packer (not shown). The nozzle 215 is threadingly engaged in the pocket and sealed therein with a seal ring 216. As stated, prior art nozzles used in steam injection typically provide a critical flow of steam at lower annulus/tubing pressure ratios. At higher pressure ratios, they provide only a non-critical restriction to the flow of steam. Unlike prior art nozzles, the nozzle of FIG. 4 includes a diffuser portion 245 as well as a throat portion 250. In use, velocity of the steam increases as the pressure of the steam decreases when the steam passes through a nozzle inlet 251. Thereafter, the diffuser portion, because of the geometry of its design, causes the steam to regain much of its lost pressure. The result is a critical flow rate at a higher annulus/tubing ratio than was possible with prior art nozzles. While nozzles with diffuser portions are known, they have not been successfully utilized to inject steam at a critical flow rate into a geological formation according to the present invention.

Figure 5:
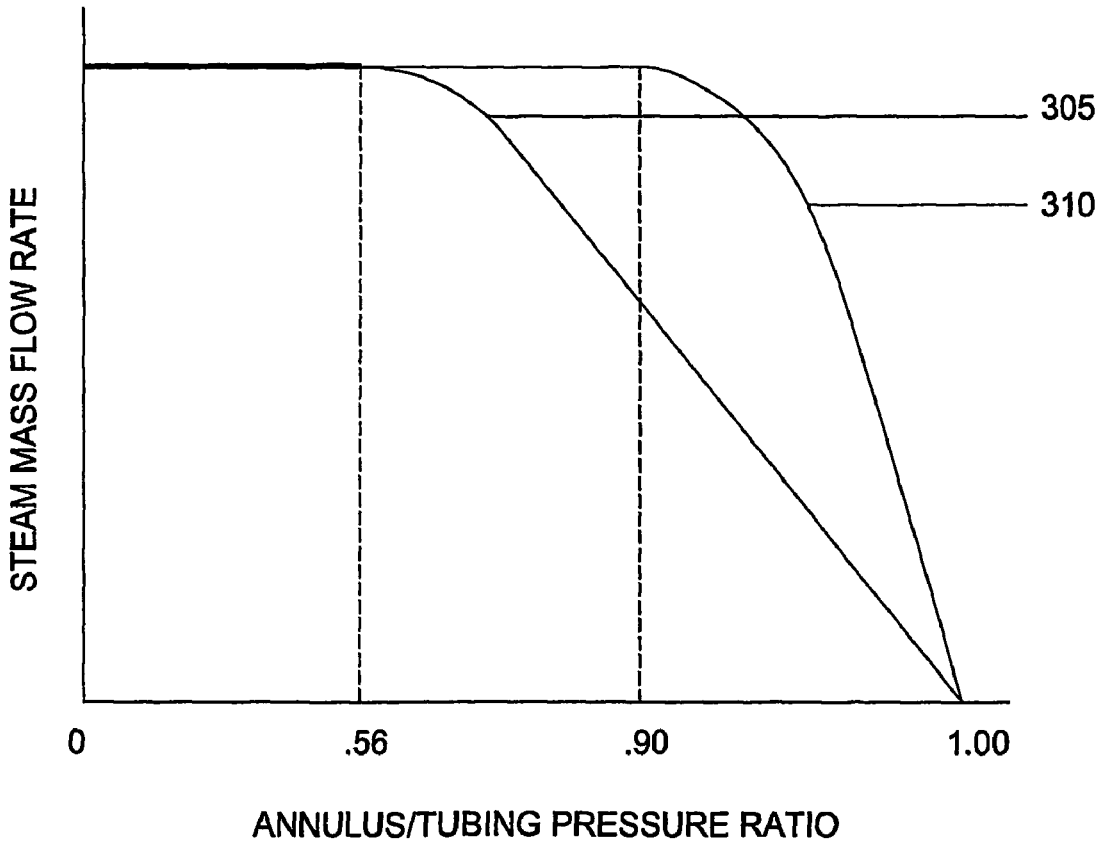
FIG. 5 is a graph illustrating pressure/flow relationships.

FIG. 5 illustrates a comparison of pressure and flow rate between a prior art nozzle (curve 305) and the nozzle of the present invention (curve 310). In a first portion of the graph, the curves 305, 310 are identical as either nozzle will produce a critical flow of steam so long as the annulus/tubing pressure ratio is at or below about 0.56. However, if the annulus/tubing pressure ratio becomes greater than 0.56, the prior art nozzle is unable to provide a critical flow of steam and becomes affected by annulus pressure and permeability characteristics of the formation. Because the nozzle of the present invention is so much more efficient in operation, it can continue to pass a critical flow of steam at higher annulus/tubing pressure ratios. In one embodiment, the nozzle can continue to pass a critical flow of steam even at an annulus/tubing pressure ratio of 0.9. The shape of curve 310 shows that using the nozzle of the present invention, critical flow is maintained so long as the annular pressure does not exceed 0.9 of the tubing pressure.

Figure 6:
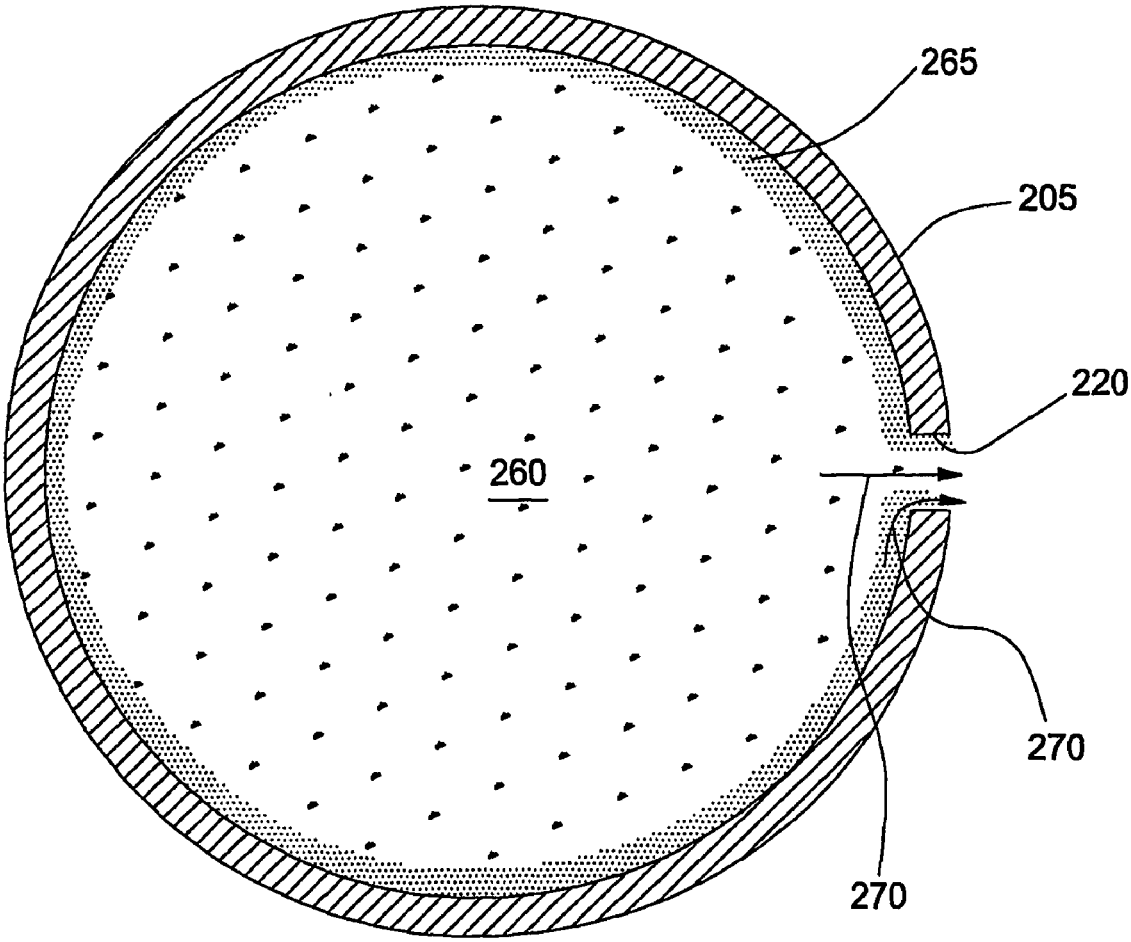
FIG. 6 is a section view of the apparatus illustrating the flow of vapor and water components of steam through the tubular member.

FIG. 6 is a section view showing the interior portion of the tubing 205 adjacent a pocket (not shown) and a single aperture 220 in the tubing 205. For clarity, the sleeve 225 with its aligned apertures 230 is not shown. Illustrated in the Figure is a portion of water 265 and a portion of vapor 260 that includes water droplets. As stated herein, pressurized steam used in an injection operation is typically made of a component of vapor and a component of water. The combination is pressurized and injected into the wellbore at the surface of the well. Thereafter, the steam travels down the tubing string 205 where it is utilized at each zone by a pocket 210 and nozzle 215 as illustrated in FIGS. 2-4.

Returning to FIG. 2, the invention utilizes a plurality of apertures 220 in the tubing 205 and apertures 230 in the sleeve 225 in order to facilitate the passage of steam from the tubing to the pocket 210 in a manner whereby the steam retains its predetermined proportions of vapor and water. At a certain velocity, steam made up of water and vapor will separate with the water collecting and traveling in an annular fashion along the outer wall of the tubular. FIG. 6 illustrates that phenomenon. As shown, vapor and water particles 260 travel in the center of the tubing 205 while the water 265 travels along with inner wall thereof. The path of the water and vapor from the tubing through the apertures is shown with arrows 270. The apertures are sized, numbered and spaced in a way whereby the proportion of water to vapor is retained as the steam passes into the pocket (not shown) and is thereafter injected into the formation around the wellbore. As described herein, the number of apertures utilized for a particular operation can be determined by using a sleeve having a desired number of apertures to align with the apertures of the tubing.

Figure 7:
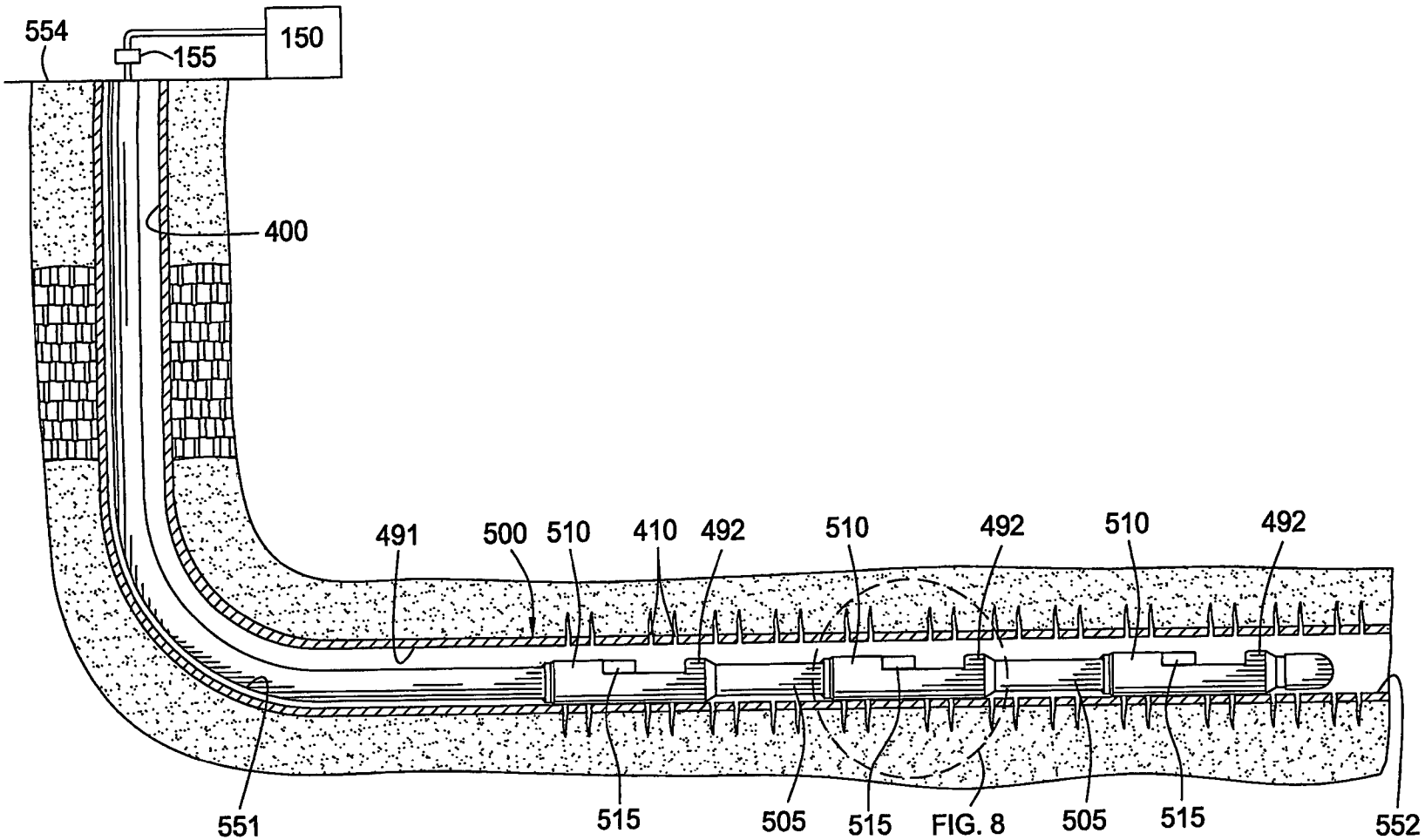
FIG. 7 is a section view of a lateral wellbore illustrating an apparatus of the present invention accessing a zone of interest in the wellbore.

FIG. 7 is a section view of an apparatus 500 of the present invention disposed in a lateral wellbore 491. As shown in FIG. 7, the lateral wellbore 491 is formed by directional drilling from a vertical wellbore 400 to extend outward essentially horizontally from the vertical wellbore 400. Disposed within the vertical and lateral wellbores 400, 491 is a tubing string 505. The tubing string 505 is typically coaxial with the vertical wellbore 400, but rests on the bottom of the lateral wellbore 491 so that the axis of the tubing string 505 is substantially parallel to the axis of the lateral wellbore 491. A steam generator 150 is located at the surface of the well and a choke 155 regulates the flow of the steam into the tubing string 505. The portion of the tubing string 505 located within the vertical wellbore 400 is depicted without the apparatus 200 described above in reference to FIGS. 2-6; however, it is understood that the tubing string 505 may include the apparatus 200 disposed within the vertical wellbore 400 along with the apparatus 500 disposed within the lateral wellbore 491.

In the embodiment of FIG. 7, the tubing string 505 includes three enlarged areas or pockets 510 formed therein, each defining an annular area with the casing and including a nozzle 515 at one end. The tubing string 505 may include any number of pockets 510. The pockets 510 are essentially concentric to allow another tubular body of a given diameter to slide over the tubing string 505. For example, a washover string placed around the tubing string 505 to clean sand out of the annular area between the tubing string 505 and the wellbore 491 is often desirable to utilize in wellbore operations. Concentric pockets 510 permit a washover string of smaller diameter to be used than the diameter required for a washover string used with the pockets 210 of FIGS. 2-6.

The pockets 510 are placed at regular intervals along the length of the lateral wellbore 491. Each of the pockets 510 is preferably formed in a sub that can be located in the tubing string 505 and subsequently positioned adjacent the zone of interest. Each nozzle 515 provides fluid communication between the apparatus 500 and perforations 410 in the zone of interest. The distribution of pressure within the horizontal injection zone is caused to be more uniform by the use of multiple subs injecting steam into the annulus of the wellbore at regular intervals. Uniform pressure in the wellbore causes uniform flow of steam into the zone of interest throughout the length of the lateral wellbore 491. The injection of steam in this manner is preferable to the non-uniform steam injection that is produced by an open casing with higher pressure at the heel than at the toe of the lateral wellbore 491. The number of subs utilized depends upon the degree of injection uniformity that is desired. The subs are connected within the tubing string 505 by threaded connectors 517 at each end.

Figure 8:
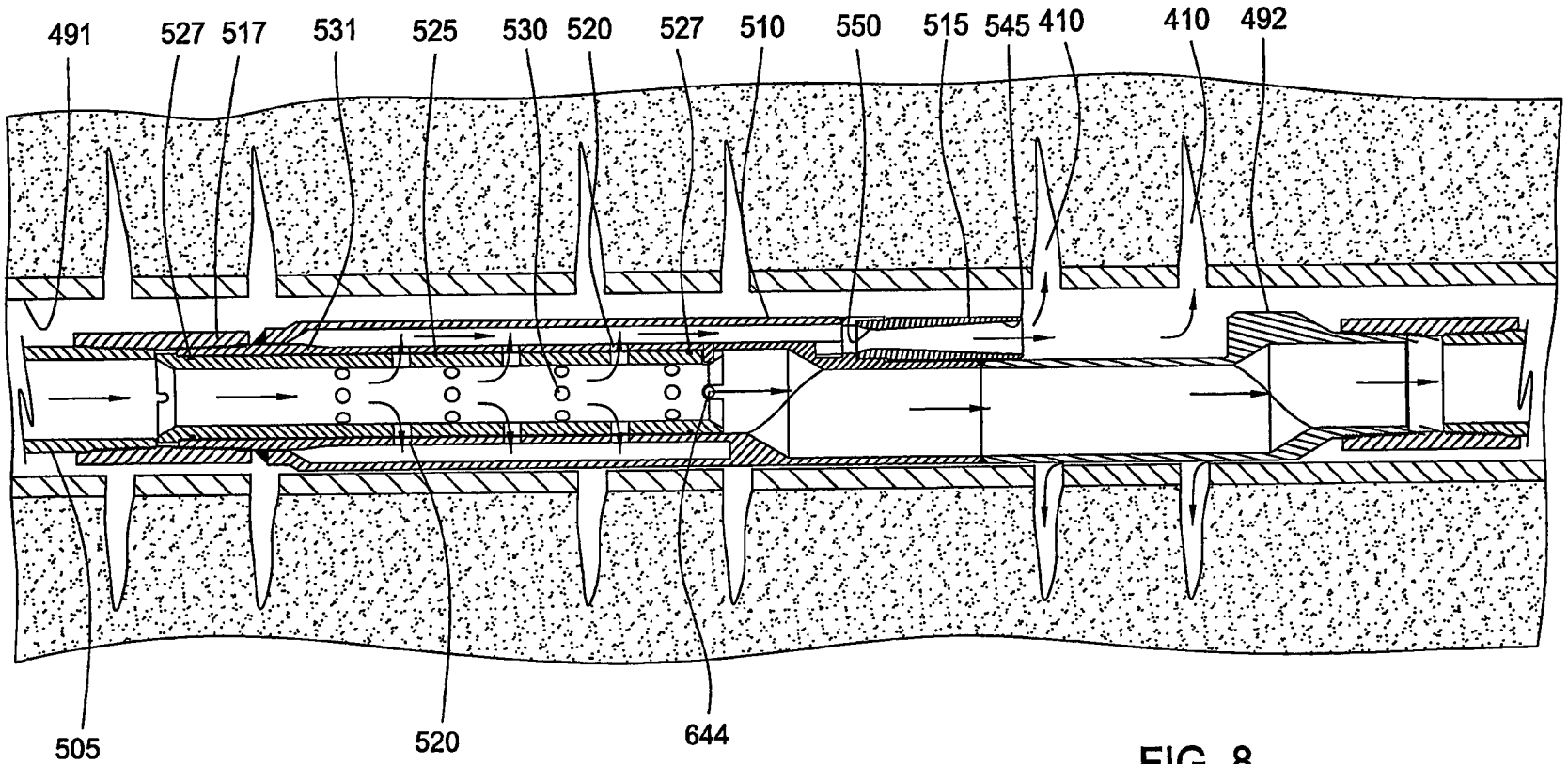
FIG. 8 is an enlarged section view of the apparatus of FIG. 7 including a tubular body with apertures in a wall thereof, a pocket formed around the body, and a nozzle having a diffuser portion.

Encumbering members 492 are disposed on the tubing string 505 across from the blowing end of each nozzle 515, as shown in FIGS. 7-8. The encumbering members 492 disrupt the velocity and jetting action of the nozzle 515 so that steam is supplied to the annulus without flow preference in the direction of the nozzle 515. Encumbering members 492 are included so that the steam is injected into the formation at a substantially uniform pressure and flow rate along the length of the wellbore 491.

FIG. 8 shows a portion of the apparatus of FIG. 7 including the tubing string 505 and one of the pockets 510. Each nozzle 515 possesses a throat 550 and diffuser portion 545 to efficiently use the steam, as described above in relation to FIGS. 2-6. Also as described above, the nozzle 515 is threadingly engaged or clamped in the pocket 510 and sealed therein with a seal ring (not shown). A plurality of apertures 520 formed in a wall of the tubing string 505 adjacent the pocket 510 provide fluid communication between the tubing string 505 and the pocket 510. If the tubing string 505 shown in FIGS. 2-6 were utilized in a lateral wellbore 491, the steam would separate into water and vapor along the length of the lateral wellbore 491 from a heel 551 of the lateral wellbore 491 to a toe 552 of the lateral wellbore 491. The water portion of the steam tends to flow in the lower portion of the tubing string 505 along its length, while the vapor tends to flow in the upper portion of the tubing string 505 along its length. The separation of the water portion from the vapor portion along the length of the tubing string 505 results in different treatment of each area of interest with the steam, depending upon whether the apertures 520 are oriented near the bottom or the top of the pocket 510. To prevent this problem from occurring, the apertures 520 are distributed circumferentially around the pocket 510 so that some of the apertures 520 are always located near both the bottom and the top of the pocket 510, regardless of the orientation of the pocket 510 in the horizontal wellbore 491.

Figure 9:
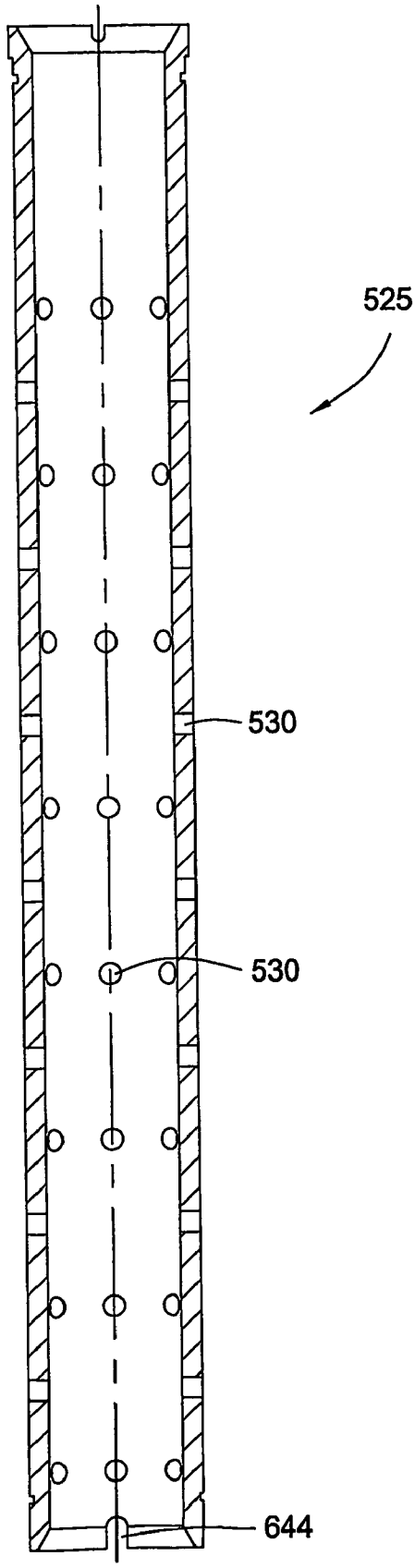
FIG. 9 is a side view of a sleeve with apertures for use with the apparatus of the present invention.

Also included in the apparatus of FIG. 8 is a sleeve 525 located inside the pocket 510 which is preferably fitted into the perforated inner flow conduit 531 prior to run-in of the apparatus 500. An enlarged view of the sleeve 525 is illustrated in FIG. 9. The sleeve 525 possesses a plurality of apertures 530 which are circumferentially distributed around the sleeve 525. The apertures 530 of the sleeve 525 may be aligned with the apertures 520 in the perforated inner flow conduit 531 to pass a given amount of steam therethrough to treat the zone of interest. The apertures 520, 530 facilitate the passage of steam from the perforated inner flow conduit 531 to the pocket 510 so that the steam retains the proportions of vapor and water predetermined at the surface of the wellbore. The apertures 520 are numbered, sized, and spaced so that the proportion of water and vapor present in the steam remains the same as the steam passes into the pocket 510 and is thereafter injected into the area of interest in the formation. The sleeve 525 may be employed to select the number of apertures 520 used for a particular operation. Fewer apertures 530 in the sleeve 525 produce proportional steam quality when used with nozzles 515 having a smaller diameter throat 550. Alternatively, more apertures 530 are needed when used with nozzles 515 having larger diameter throats 550. By installing a sleeve 525 with an appropriate number, size, and distribution of apertures 530 for a particular size (throat diameter) of nozzle 515, it is possible to produce the desired liquid/vapor ratio with any particular nozzle 515. Therefore, a range of nozzle 515 sizes may be used without the need to produce a different pocket 510 which is appropriate for each size (throat diameter) of nozzle 515.

Because the apertures 530 are circumferentially distributed, fluid communication exists around the diameter of the perforated inner flow conduit 531 when the apertures 520 and 530 are aligned so that a uniform distribution of water and vapor treats each area of interest along the lateral wellbore 491. A larger number of apertures 520 may exist in the perforated inner flow conduit 531 than the number of apertures 530 that exist in the sleeve 525, but the apertures 520 which are covered by the sleeve 525 are rendered ineffective. Only the apertures 520 which align with the apertures 530 in the sleeve 525 are open to allow flow of steam therethrough. In this way, the sleeve 525 permits selective use of the apertures 520 depending upon the amount of steam (diameter of nozzle) needed in the zone of interest.

The sleeve 525, as described above in relation to FIGS. 2-6, may have fewer apertures 530 than the apertures 520 in the perforated inner flow conduit 531 to adjust the liquid/vapor ratio of the steam that flows out of the pocket 510. The characteristics of the steam at a particular pocket 510 may be determined by utilizing a sleeve 525 with more or fewer apertures 520 rather than fabricating separate pockets 510 for each application. The sleeve 525, much like the sleeve 225, is sealed within the tubing string 505 by seal rings 527 located at each of its ends. Moreover, the apertures 520 and 530 are rotationally aligned by a slot and pin arrangement 644 between the sleeve 525 and the tubing string 505.

In use, as shown in FIG. 7, the apparatus 500 delivers steam from the steam generator 150 located at a surface 554 of the well to the zone of interest, while ensuring that the length of the zone of interest receives a predetermined amount of steam at a nearly constant pressure. The amount of steam injected into the zone of interest along the length of the lateral wellbore 491 is determined by the supply pressure at the surface and the characteristics of the nozzle 515. The nozzle 515 is the same as the nozzle 215, and therefore imparts the same advantages over prior art nozzles within the lateral wellbore 491 of FIGS. 7-8 as within the vertical wellbore 100 of FIGS. 2-6. As such, FIG. 5 applies equally to the apparatus 500 of FIGS. 7-8.

Specifically, steam is supplied from the steam generator 150 into the tubing string 505. The steam flows through the vertical wellbore 400 portion of the tubing string 505 and into the lateral wellbore 491 portion of the tubing string 505. Alternatively, the steam flows through the tubing string which has been disposed in the directionally drilled portion of the formation. Referring to FIG. 8, the flow of the steam through a portion of the apparatus 500 is represented by arrows. The steam travels through the tubing string 505, then enters the sleeve 525. The steam then flows through the apertures 530 and through the apertures 520 into the pocket 510. The steam next flows into the area with the least obstruction, namely the portion of the pocket 510 with the nozzle 515 connected thereto.

The steam then flows further downstream after exiting the nozzle 515 until it is hindered by the encumbering member 492. The encumbering member 492 forces a portion of the steam to remain in between the nozzle 515 and the encumbering member 492, so that the whole of the steam does not flow in the direction in which the nozzle 515 dispenses the steam. In this way, the pressure and flow rate of the steam is more equally distributed along the length of the zone of interest.

Figure 10A:
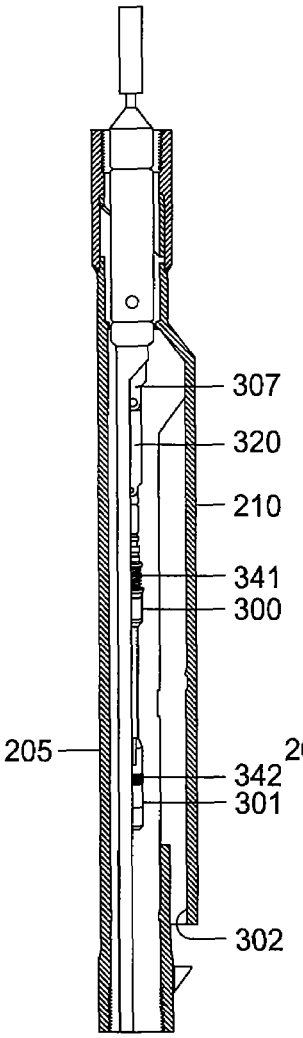
FIG. 10A-10D are section views showing the insertion of a removable nozzle portion of the invention.
Figure 10B:
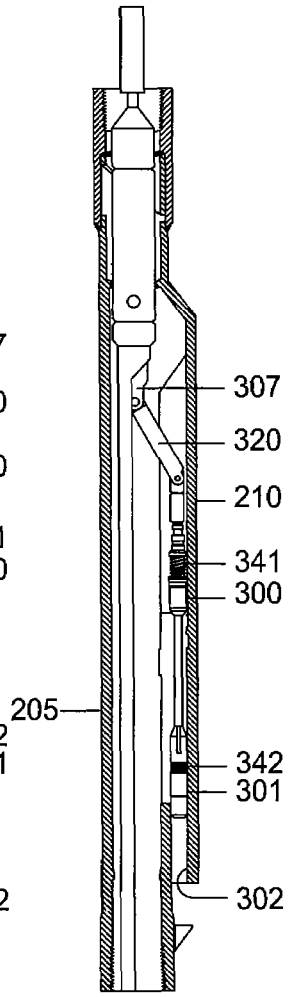
Figure 10C:
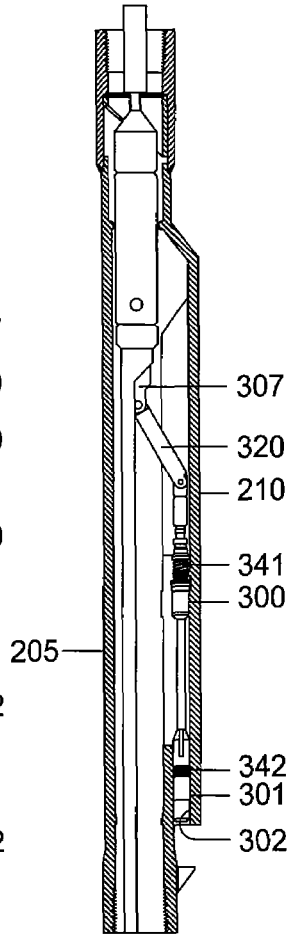
Figure 10D:
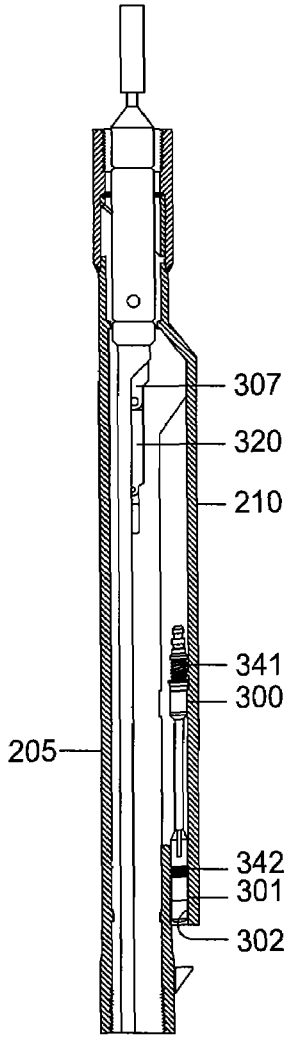

FIGS. 10A-10D illustrate a method and apparatus for remotely disposing a nozzle assembly in a pocket formed in a side of a tubular body. The method is particularly valuable when formation conditions change and it becomes desirable to decrease or increase the amount of steam injected into a particular zone. With the apparatus described and shown, a nozzle with different characteristics can be placed in the wellbore with minimal disruption to operation. FIG. 10A is a section view illustrating a section of tubing 205 with a pocket 210 formed on a side thereof. Locatable in the pocket is a nozzle assembly 300 which includes a nozzle 301 which is sealingly disposable in an aperture 302 formed between an outer wall of the tubular and the inner wall of the pocket 210. The nozzle has the same throat and diffuser portions as previously described in relation to FIG. 4. At an upper end of the nozzle assembly is a latch 341 for connection to a "kick over" tool 307 which is constructed and arranged to urge the nozzle assembly 300 laterally and to facilitate its insertion into the pocket. The kick over tool includes a means for attachment to the nozzle assembly 300 as well as a pivotal arm 320 which is used to extend the nozzle assembly 300 out from the centerline of the tubular 205 and into alignment with the pocket 210. In FIG. 10A, the nozzle assembly 300 is shown in a run in position and is axially aligned with the centerline of the tubular 205. In FIG. 10B, the kick over tool 307 has been actuated, typically by upward movement from the surface of the well, and has been aligned with and extended into axial alignment with the pocket 210. In FIG. 10C, downward movement of the nozzle assembly 300 has located the nozzle 301 in a sealed relationship (seal 342) with a seat 302 formed at a lower end of the pocket 210. In FIG. 10D, a shearable connection between the nozzle assembly 300 and the kick over tool 307 has been caused to fail and the kick over tool 307 can be removed from the wellbore, leaving the nozzle assembly 300 installed in the pocket 210.

In addition to installing and removing a modular nozzle, the embodiment of FIGS. 10A-10D also provide a remotely installable and removable sleeve having apertures in a wall thereof. In this manner, the nozzle can be installed in the pocket without interference. In one aspect, the sleeve is removed from the apparatus in a separate trip before the nozzle is removed. In another aspect, the sleeve is returned to the apparatus and installed after the nozzle has been installed.

Figure 11:
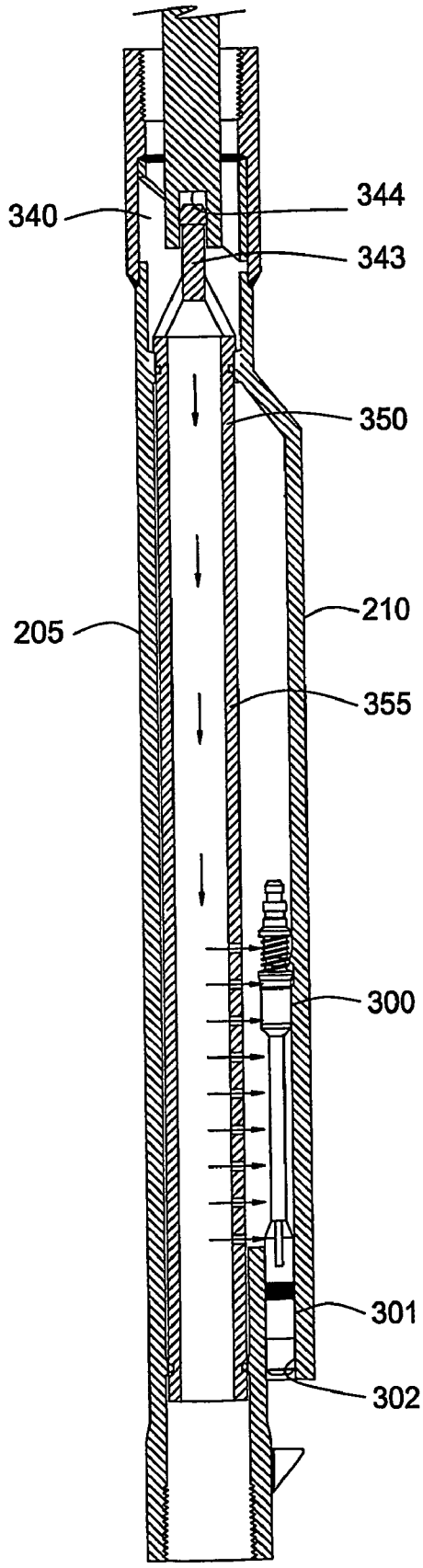
FIG. 11 is a section view showing a removable sleeve with apertures.

FIG. 11 illustrates a removable sleeve 350 in the tubing 205 between the interior of the tubing and the nozzle assembly 300. The sleeve includes apertures 355 formed in a wall thereof to control the proportionate flow of steam components as described previously. Also visible is a run in tool 340 used to install and remove the sleeve and a pin and slot arrangement 343, 344 permitting the sleeve to be placed and then left in the apparatus. Typically, the removable sleeve 350 is inserted adjacent the pocket 210 after the removable nozzle assembly 300 has been installed. Conversely, the sleeve 350 is removed prior to the removal of the nozzle assembly 300.

It will be understood that while the methods and apparatus of FIGS. 10A-10D and 11 have been discussed as they would pertain to installing a nozzle, the same methods and apparatus are equally usable removing a nozzle assembly from a pocket formed on the outer surface of a tubular and the invention is not limited to either inserting or removing a nozzle assembly. Furthermore, while the methods and apparatus of FIGS. 10A-D and 11 have been discussed as pertaining to the apparatus 200 of FIGS. 2-6, the same methods and apparatus are equally usable in the apparatus 500 for use in a lateral wellbore 491 depicted in FIGS. 7-8.

In addition to providing a controlled flow of steam to multiple zones in a single wellbore, the nozzle of the present invention can be utilized at the surface of the well to provide a controlled flow of steam from a single steam source to multiple wellbores. In one example, a steam conduit from a source is supplied and a critical flow-type nozzle is provided between the steam source and each separate wellbore. In this manner, a controlled critical flow of steam is insured to each wellbore without interference from pressure on the wellbore side of the nozzle.

In addition to providing a means to insure a controlled flow of steam into different zones in a single wellbore, the apparatus described therein provides a means to prevent introduction of steam into a particular zone if that becomes necessary during operation of the well. For instance, at any time, a portion of tubing including a pocket portion can be removed and replaced with a solid length of tubing containing no apertures or nozzles for introduction of steam into a particular zone. Additionally, in the embodiment providing removable nozzles and removable sleeves, a sleeve can be provided without any apertures in its wall and along with additional sealing means, can prevent any steam from traveling from the main tubing string into a particular zone. Alternatively, a blocking means can be provided that is the same as a nozzle in its exterior but lacks an internal flow channel for passage of steam.

In order to install a particular sleeve adjacent a particular pocket, the sleeves may be an ever decreasing diameter whereby the smallest diameter sleeve is insertable only at the lower most or furthest downstream zone. In this manner, a sleeve having apertures designed for use with in a particular zone cannot be inadvertently placed adjacent the wrong zone. In another embodiment, the removable sleeves can use a keying mechanism whereby each sleeve's key will fit a matching mechanism of any one particular zone. In one example, the keys are designed to latch only in an upwards direction. In this manner, sleeves are installed by lowering them or moving them downstream to a position in the wellbore below the intended zone. Thereafter, as the sleeve is raised or moved upstream in the wellbore, it becomes locked in the appropriate location. These types of keying methods and apparatus are well known to those skilled in the art.

While the foregoing is directed to embodiments of the present invention, other and further embodiments of the invention may be devised without departing from the basic scope thereof, and the scope thereof is determined by the claims that follow.

We claim:

1. An apparatus for injecting steam from a wellbore into a geological formation, the apparatus comprising:

a flow path between a well surface and formation, the flow path including at least one nozzle, the at least one nozzle including a throat portion and a diffuser portion, whereby the steam will flow through the nozzle at a critical flow rate, wherein the critical flow rate is a controlled flow rate and the flow path includes a string of tubulars extending from the well surface to the formation, the at least one nozzle located in the string of tubulars, proximate the formation; and at least one opening formed along the string of tubulars proximate the formation, the at least one nozzle connected to the at least one opening, wherein the at least one opening includes an enlarged area disposed circumferentially around the string of tubulars.

2. The apparatus of claim 1, wherein a portion of the string of tubulars within the enlarged area has apertures disposed therein which are circumferentially distributed around the string of tubulars.

3. The apparatus of claim 2, wherein the number of apertures in the tubular string is variable and selectable.

4. The apparatus of claim 3, further including an intermediate sleeve member disposable in the tubular string adjacent the apertures in the wall, the intermediate sleeve member having circumferentially distributed apertures alignable with the apertures in the wall.

5. The apparatus of claim 4, wherein the apertures in the sleeve are constructed and arranged to permit steam to pass from the tubing to the pocket while maintaining a predetermined ratio of water and vapor.

6. The apparatus of claim 1, wherein at least two enlarged areas are disposed along the tubular string.

7. The apparatus of claim 6, wherein an annular area is between each enlarged area and an adjacent formation is isolated with a packing member.

8. The apparatus of claim 1, wherein the nozzle is remotely removable.

9. The apparatus of claim 1, wherein the nozzle is remotely insertable.

10. The apparatus of claim 1, wherein the apparatus injects steam from a lateral wellbore into the formation.

11. The apparatus of claim 1, wherein the flow path further includes a fluid path formed in a wall of a casing lining the wellbore, the fluid path formed adjacent the formation.

12. The apparatus of claim 11, wherein the fluid path formed in the casing includes perforations.

13. An apparatus for injecting steam from a wellbore into a geological formation, the apparatus comprising:

a flow path between a well surface and the formation, the flow path including at least one nozzle, the at least one nozzle including a throat portion and a diffuser portion, whereby the steam will flow through the nozzle at a critical flow rate, wherein the critical flow rate is a controlled flow rate and the flow path includes a string of tubulars extending from the well surface to the formation, the at least one nozzle located in the string of tubulars, proximate the formation;

at least one opening formed along the string of tubulars proximate the formation, the at least one nozzle connected to the at least one opening, wherein the at least one opening includes a pocket;

a wall between an interior of the tubing and the at least one opening, the wall having at least one aperture formed therein, wherein the number of apertures in the wall between the tubing and the pocket is variable and selectable.

14. The apparatus of claim 13, further including an intermediate sleeve member disposable in the tubular string adjacent the apertures in the wall, the intermediate sleeve member having apertures alignable with the apertures in the wall.

15. The apparatus of claim 14, wherein the steam is saturated steam.

16. The apparatus of claim 15, wherein the steam includes a component of water and a component of vapor.

17. The apparatus of claim 14, wherein the apertures in the sleeve are constructed and arranged to permit steam to pass from the tubing to the pocket while maintaining a predetermined ratio of water and vapor.

18. The apparatus of claim 17, wherein the apertures in the wall between the tubing and the pocket are substantially perpendicular to a longitudinal axis of the tubing.

19. The apparatus of claim 18, wherein the flow of fluid through the nozzle is approximately parallel to the longitudinal axis of the tubing.

20. An apparatus for injecting steam into a lateral wellbore comprising:

a tubular string;

at least one pocket formed circumferentially around the tubular string;

at least one nozzle disposed on the tubular string, the at least one nozzle including a throat portion and a diffuser portion;

a plurality of apertures disposed circumferentially around the tubular string to provide fluid communication between an inner diameter of the tubular string and the at least one pocket; and at least one sleeve member disposable in the tubular string adjacent the plurality of apertures, wherein the at least one sleeve member comprises a plurality of apertures disposed circumferentially therearound.

21. The apparatus of claim 20, wherein the plurality of apertures in the at least one sleeve member are alignable with the plurality of apertures in the tubular string to permit steam to flow from the tubular string to the at least one pocket to maintain a predetermined ratio of water and vapor injected into a geological formation through each of at least two nozzles.

22. The apparatus of claim 20, further comprising at least one obstructing member disposed on the tubular string across from the at least one nozzle.

23. The apparatus of claim 22, wherein the at least one obstructing member prevents a portion of the steam from flowing in a direction in which the steam is dispensed from the at least one nozzle.

* * * * *

UNITED STATES PATENT AND TRADEMARK OFFICE

CERTIFICATE OF CORRECTION

PATENT NO. : 7,350,577 B2
APPLICATION NO. : 10/506695
DATED : April 1, 2008
INVENTOR(S) : Howard et al.

It is certified that error appears in the above-identified patent and that said Letters Patent is hereby corrected as shown below:

Column 11, Claim 1, Line 66, please insert --the-- after “and”.

Signed and Sealed this

Twenty-eighth Day of October, 2008

JON W. DUDAS
*Director of the United States Patent and Trademark Office*